US008528287B2

(12) United States Patent
Aboukhalil

(10) Patent No.: US 8,528,287 B2
(45) Date of Patent: Sep. 10, 2013

(54) WAINSCOT CAP

(76) Inventor: Charbel Tannious Aboukhalil, Grand Terrace, CA (US)

( * ) Notice: Subject to any disclaimer, the term of this patent is extended or adjusted under 35 U.S.C. 154(b) by 74 days.

(21) Appl. No.: 13/273,379

(22) Filed: Oct. 14, 2011

(65) Prior Publication Data

US 2013/0091800 A1 Apr. 18, 2013

(51) Int. Cl.
*E04B 2/00* (2006.01)

(52) U.S. Cl.
USPC ..... 52/506.06; 52/716.1; 52/288.1

(58) Field of Classification Search
USPC ..... 52/716.1, 244, 288.1, 287.1, 282.1, 52/281, 506.05, 506.06, 506.08, 571, 300, 52/460, 465, 466, 508, 509, 718.01, 718.04
See application file for complete search history.

(56) References Cited

U.S. PATENT DOCUMENTS

| | | | | |
|---|---|---|---|---|
| 2,947,093 | A * | 8/1960 | Masters | 434/421 |
| 5,301,484 | A * | 4/1994 | Jansson | 52/235 |
| 6,047,506 | A * | 4/2000 | Kemper | 52/179 |
| 6,170,214 | B1 * | 1/2001 | Treister et al. | 52/511 |
| 6,591,575 | B2 * | 7/2003 | Benedettini | 52/716.1 |
| D525,372 | S * | 7/2006 | Levi-Senigaglia | D25/121 |
| 8,033,066 | B2 * | 10/2011 | Griffiths | 52/235 |
| 2008/0196338 | A1 * | 8/2008 | Surowiecki | 52/281 |
| 2009/0031652 | A1 * | 2/2009 | Ortega Gatalan | 52/235 |
| 2010/0251647 | A1 * | 10/2010 | Enns | 52/302.1 |
| 2012/0304568 | A1 * | 12/2012 | Aboukhalil | 52/309.1 |

* cited by examiner

*Primary Examiner* — Robert Canfield
*Assistant Examiner* — Babajide Demuren
(74) *Attorney, Agent, or Firm* — Stetina Brunda Garred & Brucker

(57) ABSTRACT

A wainscot cap may be attached to a free edge of the plurality of panels secured to a wall. The wainscot cap may be attached to the mounting clip used to secure the plurality of panels to a wall. More particularly, the wainscot cap and the mounting clip may have a tongue and groove connection.

7 Claims, 6 Drawing Sheets

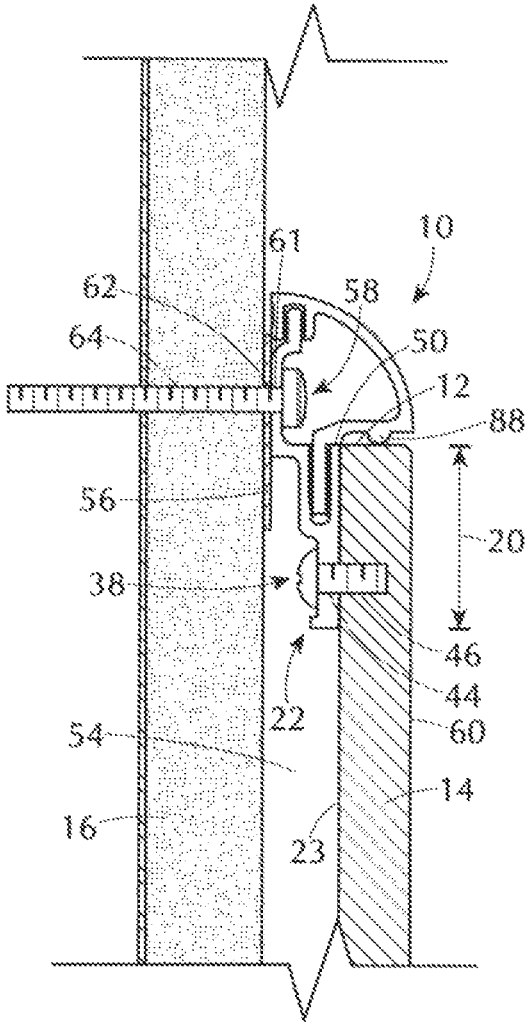
FIG. 2
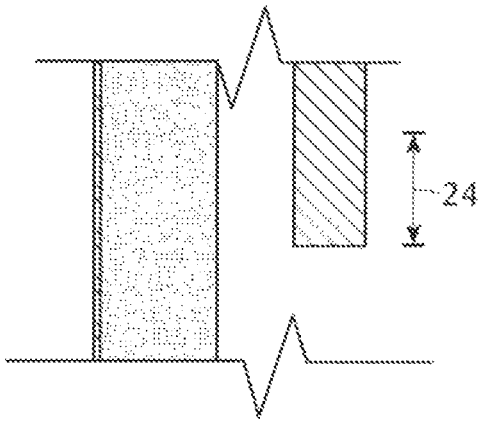

WAINSCOT CAP

CROSS-REFERENCE TO RELATED APPLICATIONS

Not Applicable

STATEMENT RE: FEDERALLY SPONSORED RESEARCH/DEVELOPMENT

Not Applicable

BACKGROUND

The embodiments discussed herein relate to a wainscot and a wainscot cap.

Walls of both commercial and residential buildings are often times covered with ornamentation and protective barriers. In high pedestrian areas such as hallways and walkways of commercial buildings, the protective barriers may comprise a plurality of panels that are stacked upon each other and secured to the wall. When pedestrians and carts accidently kick or bump into the wall, the plurality of panels are damaged instead of the wall. The panels are easily replaced and maintained.

Wainscot paneling typically extends from the floor to a middle area of the wall. The upper edge of the plurality of panels is exposed. The exposed edge may be dangerous with sharp edges and aesthetically displeasing.

Accordingly, there is a need in the art for a method and device for covering the exposed edges of the plurality of panels.

BRIEF SUMMARY

The embodiments disclosed herein address the needs discussed above, discussed below and those that are known in the art.

A plurality of panels may be mounted to a wall. At least one edge of the plurality of panels may be exposed. By way of example and not limitation, a plurality of panels may be attached to a wall as a wainscot. The top edge of the upper most row of panels is exposed. The mounting brackets and the upper edge of the top most row of panels may be exposed and aesthetically unpleasing as well as provide a safety hazard to pedestrians. A wainscot cap may be attached to the upper edge of the top most row of panels with a tongue and groove connection. In particular, the top edge of the panels 14 may be secured to the wall with a mounting clip. The mounting clip and the wainscot cap may have a tongue and groove connection. Silicone may be filled within the grooves. When the tongues are inserted into the grooves, the silicone spreads over and attaches to the interior surface of the groove and the exterior surface of the tongue to provide for a removably attachable connection between the mounting clip and the wainscot cap. The grooves and tongues may be knurled to further enhance the connection.

More particularly, a wainscot cap mounting system is disclosed. The system may comprise a panel, a mounting clip and a cap. The panel may define a generally flat and parallel front and rear surfaces. The mounting clip may having a first base (i.e. panel base) securable to an edge portion of the rear surface of the panel and a second base (i.e. surface base) securable to a front side of a flat surface. The first and second bases may be respectively coplanar with first and second planes which are parallel to each other and gapped apart from each other. The first and second bases may each have an aperture for receiving first and second fasteners to respectively secure the first and second bases to panel and the flat surface. First and second axes of the respective apertures of the first and second bases may be perpendicular to the first and second planes and offset to each other so that during installation the first fastener may initially be secured to the rear surface of the panel and the second fastener may be subsequently fastened to the flat surface. The cap may be attached to the mounting clip to hide the mounting clip.

The mounting clip may further comprise a groove defining a groove central plane parallel to the first and second planes. The groove may receive a tongue of the cap for attaching the cap to the mounting clip. The mounting clip may also have a protuberance on the second base generally parallel to the first and second planes. The protuberance may receive a groove of the cap for attaching the cap to the mounting clip.

The cap may include an extension member connected to the tongue. The extension member may be disposed adjacent to a distal edge of the panel to hide the distal edge of the panel. The extension member may have a nub 88. The cap may include an exterior member (i.e., surface 90) connected to the groove of the cap and the extension.

The exterior member may have a curved configuration.

The system may further comprise a plurality of the mounting clips and a plurality of the panels. The panels may be arranged end to end and mounted to the flat surface. The mounting clip may be attached to a distal edge portion of one or more of the plurality of panels.

In an aspect of the embodiments disclosed herein, a method of installing panels on a flat surface is disclosed. The method may comprise the steps of securing a first base of a mounting clip to a rear surface of an edge panel with a second base of the mounting clip protruding from a perimeter of the edge panel; engaging the edge panel to the flat surface; securing the second base to the flat surface after securing the first base to the rear surface of the edge panel: and securing a cap to the mounting clip to hide the mounting clip and protect the perimeter of the edge panel.

The step of securing the cap to the mounting clip may include the step of providing a tongue and groove connection between the mounting clip and the cap.

In the method, the cap may have a groove and the mounting clip has a tongue. The step of securing the cap to the mounting clip may include the step of inserting the tongue into the groove.

The method may further comprise the step of adhering the tongue in the groove with silicone.

In the method, the mounting clip may have a groove and the cap may have a tongue and the securing the cap to the mounting clip may include the step of inserting the tongue into the groove.

The method may further comprise the step of adhering the tongue in the groove with silicone.

The step of securing the second base to the flat surface may include the step of tilting the panel about an opposed edge of the edge panel. The step of securing the second base to the flat surface may include the step of shimming the second base to align the exposed surface.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 2 is a cross sectional view of the wainscot and wainscot cap shown in FIG. 1;

DETAILED DESCRIPTION

Figure 1:
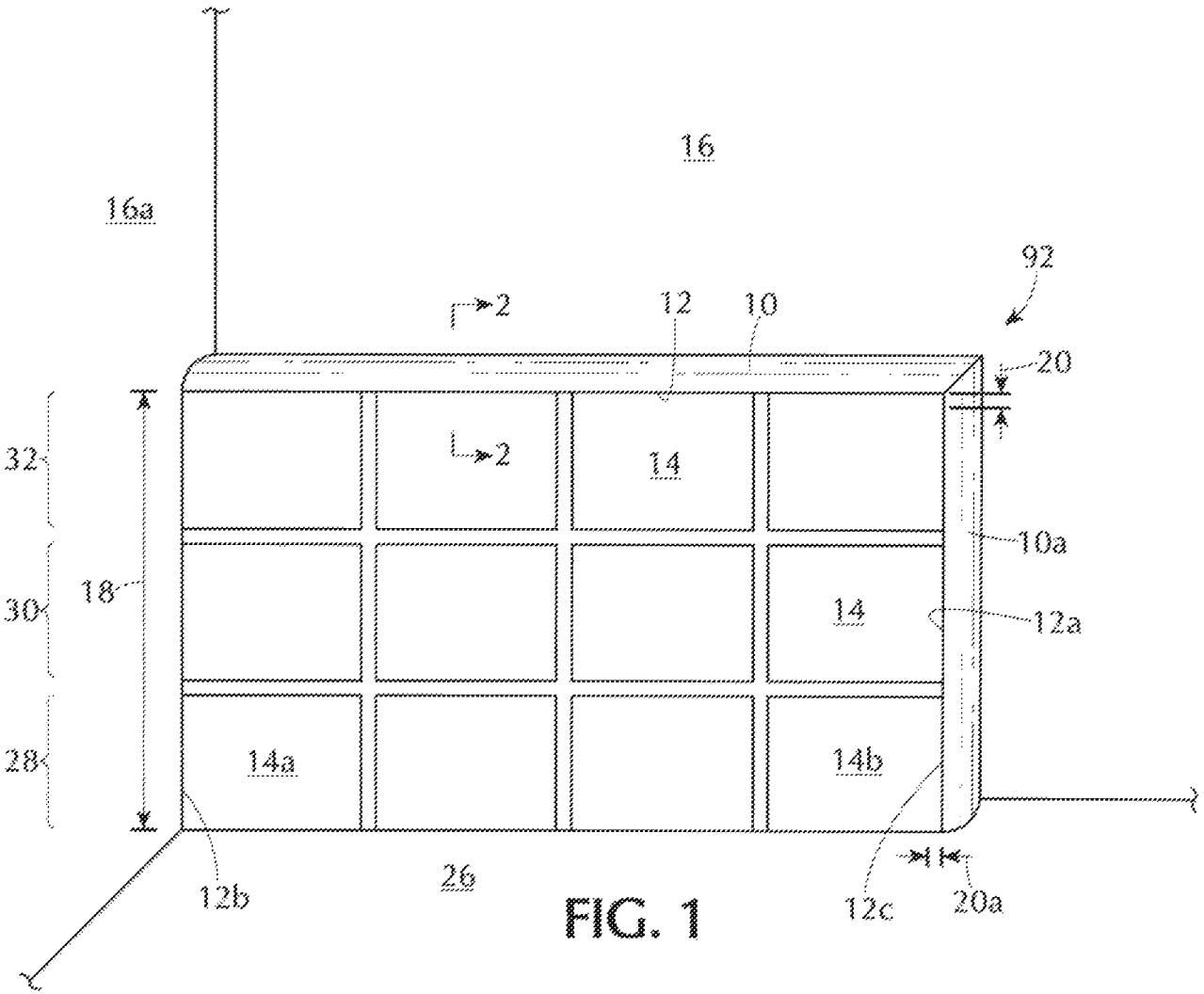
FIG. 1 is a perspective view of a wall with a wainscot and a wainscot cap.

Referring now to the drawings, a cap 10 that covers an edge 12 of a panel 14 is shown. The cap 10 hides mounting clips that are utilized to secure the panels 14 to the wall 16. The plurality of panels 14 may be mounted to a wall up to a certain height 18 (e.g., 36 in. 48 in. etc.). The cap 10 may be disposed on the upper most row of panels 14 to hide the mounting members used to attach the upper most row of panels 14 to the wall 16. The cap 10 provides an aesthetic covering. Moreover, the plurality of panels 14 may have a vertical column of panels 14 that do not abut an adjacent wall 16*a* as is shown on the left side of FIG. 1. The right most vertical column of panels 14 may have an exposed free edge 12*a*. The cap 10*a* may be used to hide the mounting members used to secure the right most vertical column of panels 14 to the wall 16. The cap 10*a* provides an aesthetic covering for the edge 12*a* of the right most vertical column of panels 14. The panels 14 may be secured to the wall 16 with a mounting clip 22. The mounting clip 22 is secured to the panel 14, then subsequently secured to the wall 16. The cap 10, 10*a* may be secured to the mounting clip 22 by way of a tongue and groove connection.

Referring to FIGS. 1 and 2, the panel 14 may define a free edge portion 20. A clip 22 is initially attached to a backside 23 of the panel 14 at the free edge portion 20. After the opposite edge portion 24 of the panel 14 is secured to the wall 16, the panel 14 is adjusted so that the clip 22 contacts the wall 16. The clip 22 is now secured to the wall 16. The cap 10 may be subsequently secured to the clip 22 by way of a tongue and groove connection. Although the various aspects and embodiments are described in relation to a plurality of panels 14 being secured to a vertical wall 16, it is also contemplated that various aspects and embodiments may be applied to a horizontal ceiling, any flat surface, or curved surface.

FIG. 1 illustrates two adjacent walls 16, 16*a* which are typically at 90' to each other. One or more of the walls 16, 16*a* may be covered with a plurality of panels 14 that are stacked end to end upon each other. The panels 14 may extend from the floor 26 to a ceiling but may also be stacked midway to the height 18. The plurality of panels 14 are shown as being secured to the vertical wall 16. However, the panels 14 may also be arranged on the floor 26, ceiling, exterior wall/surface, etc. The plurality of panels 14 may be secured to the wall 16 through various means known in the art or developed in the future. By way of example and not limitation, the plurality of panels 14 may be secured to the wall 16 as described in U.S. patent application Ser. No. 13/118,937, filed on May 31, 2011; U.S. patent application Ser. No. 13/149,125, filed on May 31, 2011; and U.S. patent application Ser. No. 13/149,143, filed on May 31, 2011, the entire disclosures of which are expressly incorporated herein by reference. The mounting clips 22 and caps 10, 10*a* would be used on the exposed free edge of the panels 14.

The panels 14 are installed on the wall 16 by first installing a first row 28 of panels 14. The edge 12*b* of panel 14*a* is covered by the wall 16*a*. The wall 16*a* hides the mounting members. The edge 12*c* of panel 14*b* is exposed. As will be explained further below in relation to the edge 12 of the upper most row of panels 14, the edge portion 20*a* of the right most vertical column may be secured to the wall 16 by way of clip 22. The clips 22 may be hidden with the cap 10*a*. The second and third rows 30, 32 may be stacked upon each other as shown in FIG. 1. The plurality of panels 14 may comprise a first row 28 or one or more additional rows 30, 32 as desired. For a wainscot, the plurality of panels 14 may extend from the floor to the bottom edge of the window seal in the room or the height of the electrical system in the room. In any event, the plurality of panels 14 typically extends from the floor to a middle area of the wall 16. The upper edge 12 of the upper most row 32 of panels 14 is exposed and may be covered by the cap 10.

Figure 3:
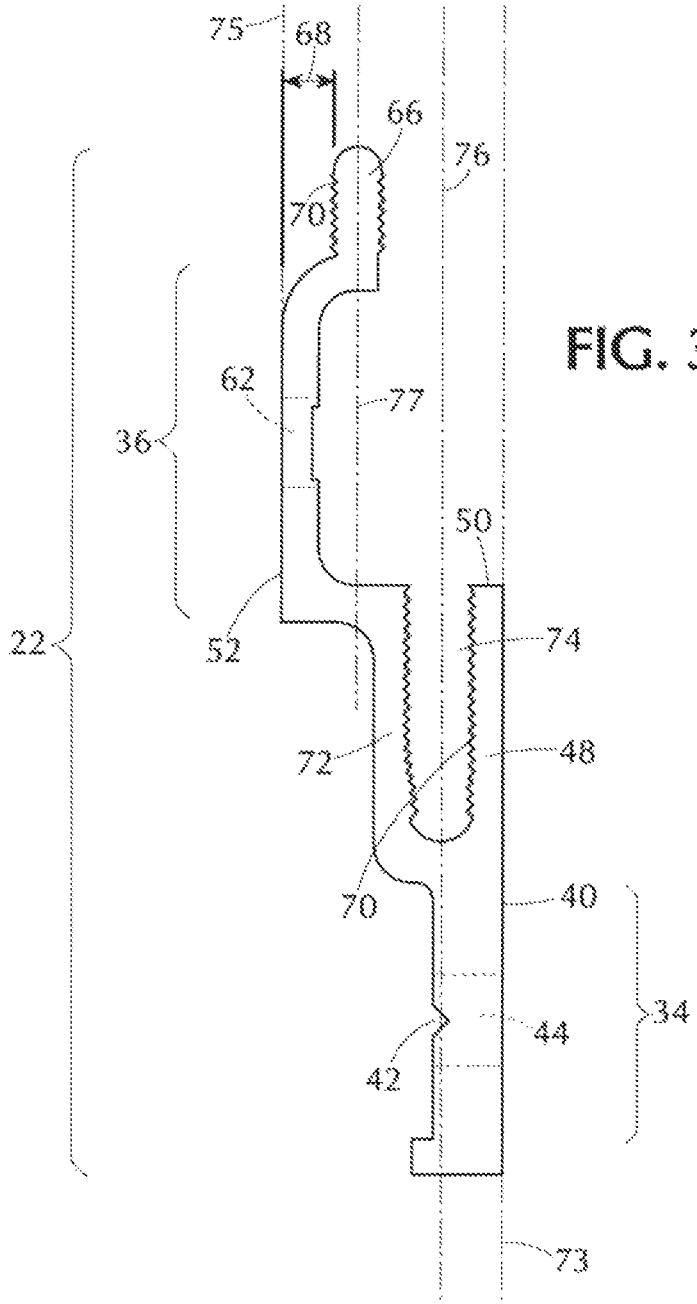
FIG. 3 is an enlarged side view of a mounting clip shown in FIG. 2 to attach a panel to a wall.

Referring now to FIG. 2 the free edge portion 20 of the upper most row 32 of panels 14 is shown. The free edge portion 20 may be secured to the wall 16 by way of clip 22, as shown in FIG. 2. As shown in FIG. 3, the mounting clip 22 may have a panel base 34 and a surface base 36. The panel base 34 may be attached to the backside 23 of the panel 14 by way of a screw 38 or other methods known in the art. The panel base 34 may define a mounting surface 40 which matches and mates with the back surface 23 of the panel 14. The clip 22 may be a plurality of short clips attached to the backside of the panel 14 or be a single elongate clip 22 that extends across the entire width of one panel 14 or all of the panels 14 within the row. The clip 22 may be sufficiently long so that the panel base 34 may have at least one area through which the screw 38 may be threaded, and preferably at least two or more areas where the screws 38 may be screwed into the panel base 34. The panel base 34 may have a starting indentation 42 to indicate the location of the screw hole 44 to be drilled through the panel base 34 at the installation site. Alternatively, the hole 44 may be predrilled at the fabricator's site for attachment of the clip 22 to the panel 14 at the fabricator's site or at the job site. The backside 23 of the panel 14 may also have matching holes 46. To mount the mounting clip 22 to the backside 23 of the panel 14, the mounting clip 22 is aligned to the panel 14 so that the holes 44 in the panel base 34 of the mounting clip 22 match up with the holes 46 in the backside 23 of the panel 14. Preferably, the mounting clip 22 has a tang 48. An upper end 50 of the tang 48 may be designed to match up with the edge 12 of the panel 14 as shown in FIG. 2. At the job site, the installer may line up the upper end 50 of the tang 48 to the edge 12 of the panel 14. The mounting clip 22 may be temporarily secured to the panel 14 such as with a c-clamp. A drill may be used to drill matching holes 44, 46 through the panel base 34 and the panel 14. In this manner, the holes 44 may be perfectly aligned to the holes 46 of the panel 14. The screws 38 may be threaded into the hole 44 and the hole 46 to secure the mounting clip 22 through the panel 14.

After mounting the mounting clip 22 to the panel 14, the mounting clip 22 may be secured to the wall 16 by securing the surface base 36 to the wall 16. The surface base 36 extends past the periphery of the panel 14 as shown in FIG. 2. The surface base 36 of the mounting clip 22 defines a mounting surface 52 which matches the shape (e.g., flat, curve, etc.) of the wall 16. In FIG. 1, the profile or shape is flat. Accordingly, the mounting surface 52 is flat. The surface base is attached to the wall 16. The mounting surfaces 40, 52 may each define a plane 73, 75 which are parallel to each other and gapped apart from each other. In this way, the panel 14 may have a gap 54

(see FIG. 2) from the wall 16. The gap 54 provides space for a shim 56, the mounting clip 22 and the screws 38, 58.

In attaching the mounting clip 22 to the wall 16, the mounting surface 52 of the surface base 36 is brought up against the exterior surface of the wall 16. Shims 56 may be inserted between the surface base 36 and wall 16 to adjust the angle of the exterior surface 16 of the panel 14. After adjusting the angle of the panel 14, a hole 62 is drilled to fabricate matching holes 61, 62, 64 through the surface base 36, shim 56 (if necessary) and the wall 16. After drilling the holes 61, 62, 64 through the surfaces base 36, shim 56 and wall 16, screw 58 is used to attach the surface base 36 to the wall 16. One or more screws 58 may be used to attach the surface base 36 to the wall 16 along a length of the surface base 36.

Referring back to FIG. 1, the clip 22 may extend horizontally across the entire row of panels 14. Alternatively, the clips 22 may extend across the entire width of each of the panels 14 or a plurality of shorter clips 22 may be attached to the panels 14 as described above.

Figure 4:
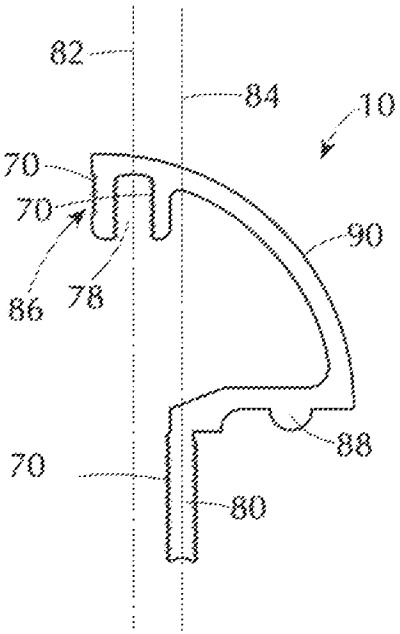
FIG. 4 is an enlarged side view of a cap removably attachable to the mounting clip shown in FIG. 3.

Referring now to FIGS. 2-4, the cap 10 may be secured to the mounting clip 22 to hide the mounting clip 22 and the edge 12 of the panel 14. To this end, the mounting clip 22 and the cap 10 may be connected to each other through a tongue and groove connection. More particularly, the mounting clip 22 may have a tongue 66 which extends parallel to the mounting surface 52. Preferably, the tongue 66 is offset from the plane 75 defined by the mounting surface 52 to provide a gap 68 there between. The tongue 66 may also have knurl 70 on an interior surface of the tongue 66. The panel base 34 and the surface base 36 may be connected to each other by way of intermediate member 72. The intermediate member 72 along with the tang 48 define a groove 74 defining a plane 76 parallel to tongue 66. The tongue 66 may define plane 77. The inner surface of the groove 74 may have knurls 70. The cap 10 (see FIG. 4) may have groove 78 and tongue 80 which mate with tongue 66 and groove 74 of the clip 22. The groove 78 and tongue 80 each define planes 82, 84. The groove 78 and the tongue 80 are parallel to each other and connect to the tongue 66 and the groove 74 of the clip 22 longitudinally. The cap 10 can be longitudinally slid onto the mounting clip 22. The tongue 80 can be received into the tongue 74. Subsequently, the tongue 66 of the mounting clip 22 is received into grooves 78 of the cap 10. To mount the cap 10 to the mounting clip 22, the groove 74 may optionally be filled with silicone or other adhesive. Additionally, the groove 78 may also be filled with silicone or other adhesive. The exterior surface of the tongue 80 and the interior surface of the groove 78 may have knurl 70. Additionally, a backside 86 of the cap 10 may also have knurls 70. The tongue 80 may initially be inserted into groove 74. As the tongue 80 is received deeper into the groove 74, the silicone spreads into the knurls 70 formed on the tongue 80 and the groove 74. As the tongue 80 is further inserted into the groove 74, the tongue 66 of the mounting clip enters the groove 78 of the cap 10. The user continues to push the tongue and groove connection further together, which spreads the silicone in the groove 78 over the knurl 70 formed in the groove 78 and the tongue 66. Optionally, the silicone may be spread on the backside 86 of cap 10. The insertion of the tongue into the groove may be limited when a nub 88 formed on the cap 10 contacts edge 12 of the panel 14. The silicone is allowed to dry and functions as a removably attachable adhesive to prevent inadvertent removal of the cap 10 from the panel 14. The cap 10 may have an aesthetic exterior surface 90. The surface 90 is shown as being curved. However, the surface 90 may have other configurations such as stair step, ornate, square, cornered, etc.

Referring back to FIG. 1, the cap 10*a* may be attached to the vertical edge 12*a* of the right most column of panels 14 in the same manner that the cap 10 is attached to the edge 12 of the upper most row of panels 14. The corner 92 may have a mating mitered caps 10, 10*a* that abut and provide a clean edge.

Figure 7:
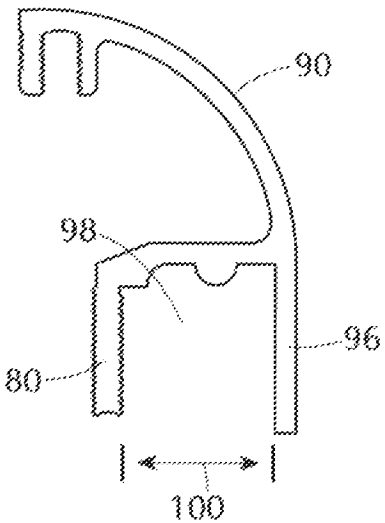
FIG. 7 is an enlarged side view of the second embodiment of the wainscot cap.
Figure 5:
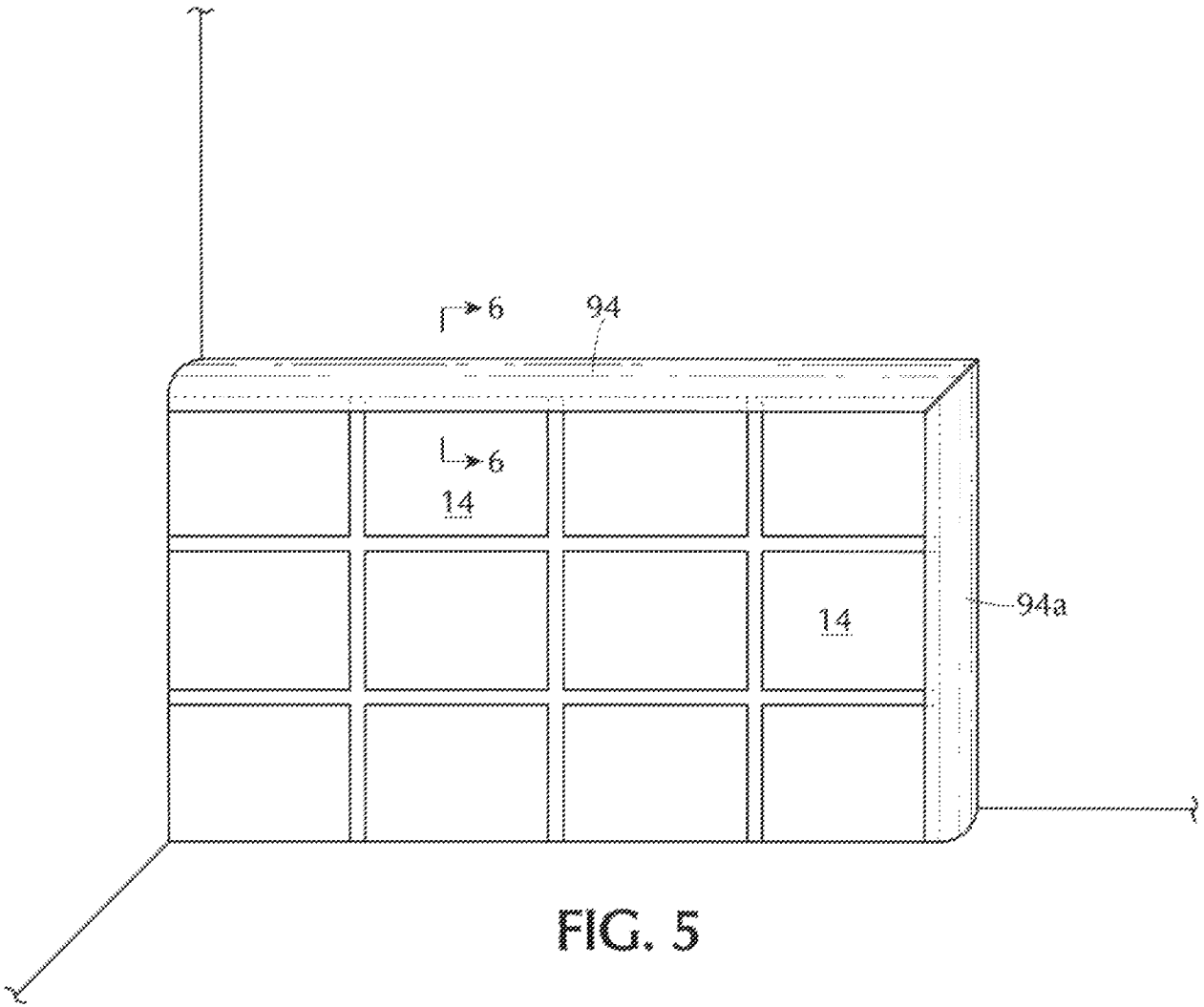
FIG. 5 illustrates a second embodiment of the wainscot cap.
Figure 6:
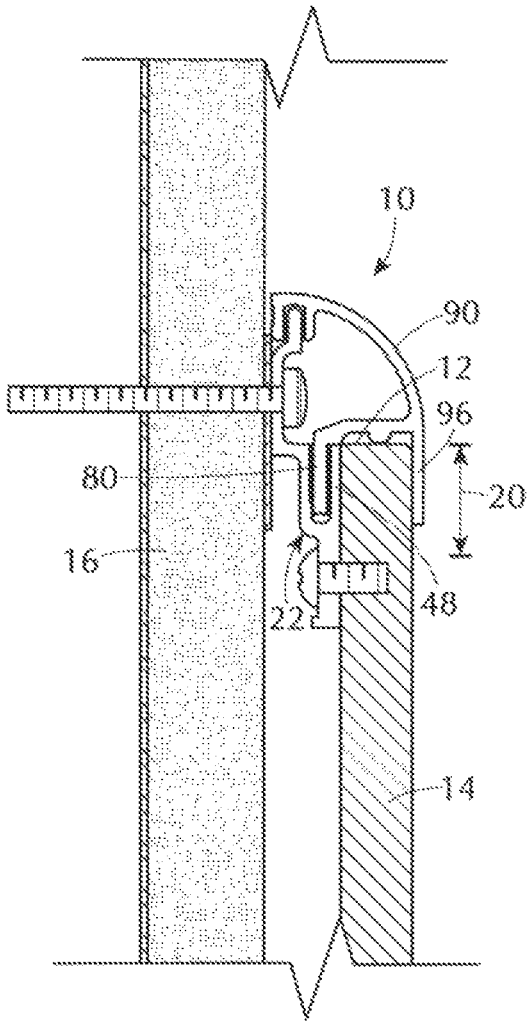
FIG. 6 is a cross sectional view of the wainscot and wainscot cap shown in FIG. 5.

Referring now to FIGS. 5-7, a second embodiment of the cap 94 is shown. The cap 94 may be attached to the upper most row of panels 14 or to the free edge of the right most column of panels 14. The panel 14 on the top side or the right side of the plurality of panels 14 may be secured to the wall 16 as discussed above with mounting clips 22. The cap 94 may be secured to the mounting clip 22 in the same manner as discussed above as well. The cap 94, 94*a* may additionally have a front plate 96 which extends down from the exterior surface 90 and forms groove 98 that receives the free edge portion 20 of the panel 14. A width 100 of the groove 98 defined by the front plate 96 and the tongue 80 may be equal to a thickness of the tang 48 of the clip 22 and the panel 14. The front plate 96 captures the panel 14 to provide additional retainment of the panel to the wall 16. Also, the front plate 96 also hides the edge 12 as well as covers the edge 12.

The embodiments disclosed herein were described as having a tongue and groove connection. By way of example and not limitation, the cap 10, 10*a* has groove 78 which receives tongue 66 of the mounting clip 22. However, it is also contemplated that the groove 78 may be formed as a tongue and the tongue 66 may be formed as a groove which receives the tongue. Likewise, the mounting clip 22 has groove 74 which receives tongue 80 of the cap 10, 10*a*. It is also contemplated that the groove 74 may be formed as a tongue and the tongue 80 may be formed as a groove which receives the tongue.

The above description is given by way of example, and not limitation. Given the above disclosure, one skilled in the art could devise variations that are within the scope and spirit of the invention disclosed herein, including various ways of mounting the panels 14 to the wall 16. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A wainscot cap mounting system comprising:

a panel defining generally flat and parallel front and rear surfaces;

a mounting clip having a first base securable to an edge portion of the rear surface of the panel and a second base securable to a front side of a flat surface, the first and second bases being respectively coplanar with first and second planes which are parallel to each other and gapped apart from each other, the first and second bases each having an aperture for receiving first and second fasteners to respectively secure the first and second bases to panel and the flat surface, first and second axes of the respective apertures of the first and second bases being perpendicular to the first and second planes and offset to each other so that during installation the first fastener may initially be secured to the rear surface of the panel and the second fastener may be subsequently fastened to the flat surface;

a cap attachable to the mounting clip to hide the mounting clip;

wherein the mounting clip and the cap are attachable to each other with a protuberance and groove connection, the protuberance being juxtaposed to the second base generally parallel to the first and second planes.

2. The system of claim 1 wherein the mounting clip further comprises a groove defining a groove central plane parallel to the first and second planes, the groove operative to receive a tongue of the cap for attaching the cap to the mounting clip.

3. A wainscot cap mounting system comprising;

a panel defining generally flat and parallel front and rear surfaces;

a mounting clip having a first base securable to an edge portion of the rear surface of the panel and a second base securable to a front side of a flat surface, the first and second bases being respectively coplanar with first and second planes which are parallel to each other and gapped apart from each other, the first and second bases each having an aperture for receiving first and second fasteners to respectively secure the first and second bases to panel and the flat surface, first and second axes of the respective apertures of the first and second bases being perpendicular to the first and second planes and offset to each other so that during installation the first fastener may initially be secured to the rear surface of the panel and the second fastener may be subsequently fastened to the flat surface;

a cap attachable to the mounting clip to hide the mounting clip;

wherein the mounting clip further comprises a groove defining a groove central plane parallel to the first and second planes, the groove operative to receive a tongue of the cap for attaching the cap to the mounting clip; and the mounting clip has a protuberance on the second base generally parallel to the first and second planes, the protuberance operative to receive a groove of the cap for attaching the cap to the mounting clip.

4. The system of claim 3 wherein the cap further includes an extension member connected to the tongue, the extension disposable adjacent to a distal edge of the panel to hide the distal edge of the panel.

5. The system of claim 4 wherein the cap further includes an exterior member connected to the groove of the cap and the extension.

6. The system of claim 5 wherein the exterior member has a curved configuration.

7. The system of claim 1 further comprising a plurality of the mounting clips and a plurality of the panels, the panels being arranged end to end and mounted to the flat surface, the mounting clip being attached to a distal edge portion of one or more of the plurality of panels.

* * * * *